US006619650B2

(12) United States Patent
Gysin et al.

(10) Patent No.: US 6,619,650 B2
(45) Date of Patent: Sep. 16, 2003

(54) DEVICE FOR FEEDING PRINTED PRODUCTS TO A CONVEYING CHANNEL

(75) Inventors: Christoph Gysin, Gelterkinden BL (CH); Heinz Boss, Strengelbach (CH)

(73) Assignee: Grapha-Holding AG, Hergiswil (CH)

( * ) Notice: Subject to any disclaimer, the term of this patent is extended or adjusted under 35 U.S.C. 154(b) by 0 days.

(21) Appl. No.: 10/067,544

(22) Filed: Feb. 7, 2002

(65) Prior Publication Data

US 2002/0105137 A1 Aug. 8, 2002

(30) Foreign Application Priority Data

Feb. 8, 2001 (EP) ..... 01810132

(51) Int. Cl.[7] ..... B65H 5/00

(52) U.S. Cl. ..... 271/10.01; 271/10.09; 271/10.1; 271/225; 271/270; 271/184; 271/202

(58) Field of Search ..... 271/10.01, 10.09, 271/10.1, 225, 270, 184, 182, 202; 198/570, 434

(56) References Cited

U.S. PATENT DOCUMENTS

| | | | | | |
|---|---|---|---|---|---|
| 3,658,322 | A | * | 4/1972 | Martin | 271/184 |
| 3,880,420 | A | * | 4/1975 | Martin | 271/184 |
| 4,724,945 | A | * | 2/1988 | Martin | 198/412 |
| 5,048,818 | A | * | 9/1991 | Nemeskal | 271/283 |
| 5,112,041 | A | * | 5/1992 | Honegger | 271/286 |
| 5,141,216 | A | * | 8/1992 | Ballestrazzi et al. | 271/10.01 |
| 5,174,559 | A | | 12/1992 | Diamantides | |
| 5,273,265 | A | | 12/1993 | Edwards | |
| 5,318,285 | A | * | 6/1994 | Edwards et al. | 271/225 |
| 5,374,052 | A | * | 12/1994 | Folsom | 271/225 |
| 5,538,240 | A | * | 7/1996 | Auerbach et al. | 271/225 |
| 5,597,156 | A | * | 1/1997 | Claassen | 271/225 |
| 5,649,698 | A | * | 7/1997 | Auerbach et al. | 271/225 |
| 5,664,772 | A | * | 9/1997 | Auerbach et al. | 271/225 |

FOREIGN PATENT DOCUMENTS

| | | | | | |
|---|---|---|---|---|---|
| CH | 677480 | A5 | * | 5/1991 | B65G/15/22 |
| CH | WO 9413567 | | * | 6/1994 | B65H/29/66 |
| DE | WO 9301115 | | * | 1/1993 | B65H/15/00 |
| DE | 4437327 | A | | 5/1995 | |
| DE | 19756539 | C | | 8/1999 | |
| EP | 0738682 | A | | 10/1996 | |
| EP | 0819641 | A | | 1/1998 | |
| EP | 1024099 | A | | 8/2000 | |
| GB | 2258458 | A | * | 2/1993 | B65H/9/00 |
| JP | 06171818 | A | * | 6/1994 | B65H/29/66 |

* cited by examiner

*Primary Examiner*—Donald P. Walsh
*Assistant Examiner*—M. Kohner
(74) *Attorney, Agent, or Firm*—Venable LLP; Robert Kinberg

(57) ABSTRACT

A device is used to insert and/or deposit printed products into a conveying channel. The printed products are conveyed in the conveying channel with of carriers of a conveying element. An acceleration apparatus pre-accelerates the printed products in conveying direction. The acceleration apparatus conveys the printed products essentially in a straight line and at an angle to the conveying direction of the conveying channel. The printed products are preferably inserted with the aid of conveying belts and at an angle into the conveying channel. As a result of the slanted feed, the divisions of the conveying element can be optimized and the capacity increased.

28 Claims, 3 Drawing Sheets

DEVICE FOR FEEDING PRINTED PRODUCTS TO A CONVEYING CHANNEL

CROSS-REFERERNCE TO RELATED INVENTION

Priority is claimed herein with respect to European Patent Application No. 01810132.9, filed in the European Patent Office on Feb. 8, 2001, the subject matter of which is incorporated herein by reference.

BACKGROUND OF THE INVENTION

The invention relates to a device for feeding printed products to a conveying channel, in which the printed products are conveyed with the aid of carriers installed at a distance to each other on a conveying element. The device includes an apparatus for pre-accelerating the supplied printed products in a conveying direction of the conveying channel.

European Patent Application No. 0 738 682 A, incorporated herein by reference, describes a device used to insert supplements into an insertion channel having a conveying chain. The chain is provided with regularly spaced, finger-type drivers that project into the insertion channel. The supplements are pulled with a withdrawal or pull-off roller from a stack and fed to two rotating vacuum platforms or discs via belts moving perpendicular to the conveying direction of the insertion channel. The essentially horizontally positioned vacuum discs rotate in the same direction and are respectively provided with an intake opening connected within a range of approximately 90° to a suction channel. Approximately half of each vacuum disc is positioned inside the insertion channel. The supplements to be supplied are transferred with the belts to the two vacuum discs and are seized by the vacuum force at the intake openings. The rotation of the two vacuum discs respectively imposes a translatory movement onto the seized supplement to accelerate the supplement in the conveying direction of the insertion channel. This acceleration of the supplement serves to pre-accelerate the supplement relative to the insertion channel. The pre-acceleration reduces the force exerted by the drivers onto the edge of the printed product.

Since only one surface of the product can be seized by the rotating vacuum platforms, this known device only permits the processing of lightweight and stable individual sheets within a limited format range.

SUMMARY OF THE INVETION

It is an object of the invention to provide a device of the aforementioned type, which permits the processing of unstable printed products and products with differing formats.

The above and other objects are solved by the present invention wherein, in the context of the device first mentioned above, a conveying means conveys the printed products in a straight line and supplies the products at an angle to the conveying direction of the conveying channel. The slanted conveying direction of printed products makes it possible to realize a shorter spacing between carriers of the conveying channel than would be otherwise possible with an apparatus that conveys the products in a direction perpendicular to the conveying channel. The present invention also enables a lower transporting speed of the products withdrawn from the stack. Besides the pre-acceleration in the conveying direction of the conveying channel, the slanted feeding also reduces the speed component extending at a right angle to the channel and leads to a reduction of the force of the carriers onto the edge of each printed product. The reduction of the speed component, extending at a right angle to the conveying channel, also reduces the speed with which the printed products impact an opposite arranged guide wall of the conveying channel. Another advantage of the device according to the present invention is that it can be used with supplements as well as main products.

According to one modification of the invention, comparably thin individual sheets as well as thick main products can be fed into the conveying channel or inserted into other passing printed products passing.

According to another modification, the conveyor belt drive is integrated directly into a drum feeder, which results in particularly good ergonomic conditions for manually supplying the feeder. A short distance between the feeder shaft and the conveying channel permits manual feeding and operation from the channel side. This integration is particularly advantageous structurally and is reliable, according to another modification of the invention, if the rollers on a withdrawing drum are positioned at an angle and the printed products are conveyed by these rollers at an angle to the conveying direction of the conveying channel. Identically aligned inner and outer belts are preferably arranged around these slanted rollers to convey the printed products into the conveying channel. Guide rods extending parallel to the rotational axis of the withdrawing drum preferably carry the slanted rollers. A drum feeder of this type is disclosed, for example, in European Patent Application 1024099, incorporated herein by reference.

Further advantageous features follow from the description below and the drawings.

BRIEF DESCRIPTION OF THE DRAWINGS

Two exemplary embodiments of the invention are explained in further detail in the following with the aid of the drawings.

DETAILED DESCRIPTION OF THE INVENTION

Figure 1:
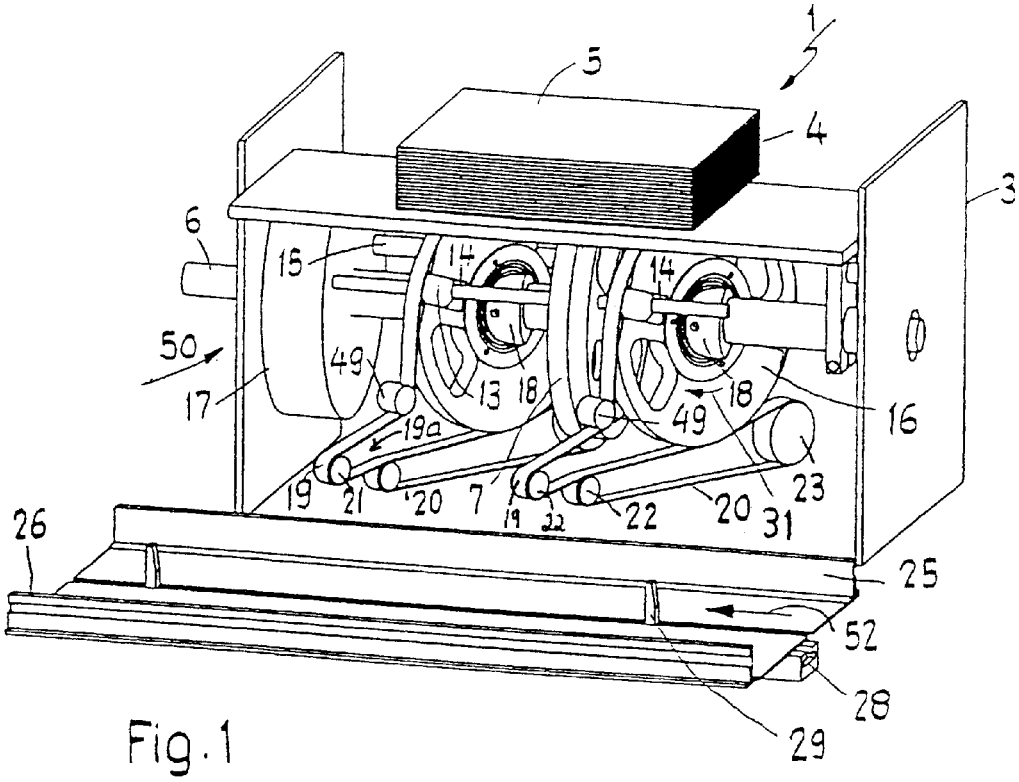
FIG. 1 shows a schematic three-dimensional view of a device according to the present invention.
Figure 2:
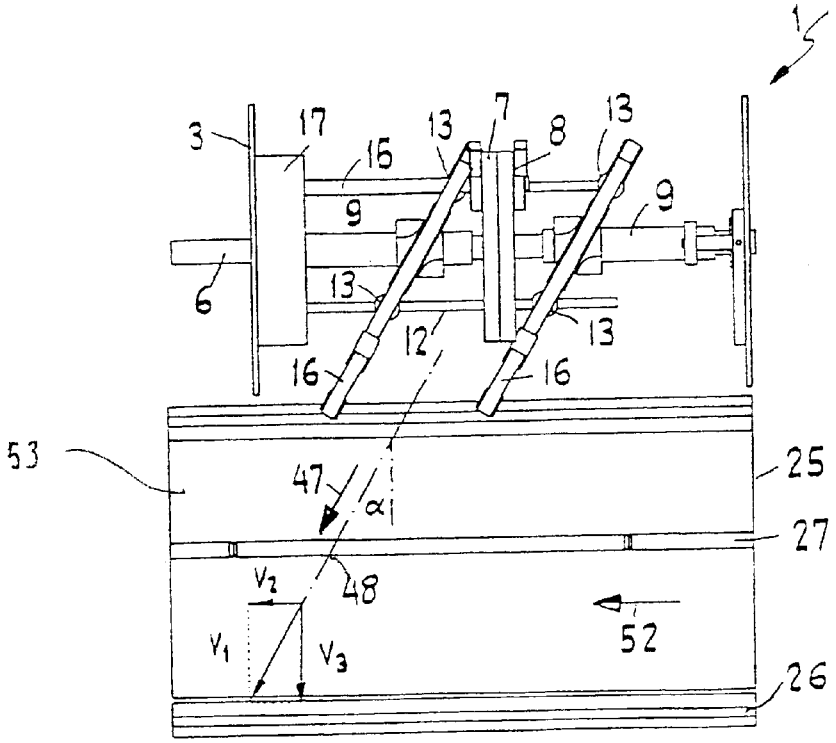
FIG. 2 shows a top view of the device according to FIG. 1, with certain parts omitted for clarity.

The device 1, shown in FIGS. 1 and 2, is provided with a drum feeder 50, which has as a shaft 6 positioned on a frame 3. At least one gripper disc 7 is rotatably mounted to this shaft 6. The gripper disc 7, according to FIG. 2 and which is known, is provided with grippers 8 along its circumference for pulling individual printed products 5 from the underside of a stack 4. The grippers 8 are activated via a gripper shaft 15 positioned in a known manner on a drive pulley 17 of the drum feeder 50 rotating on the frame 3. The gripper shaft 15 is driven via pinions and toothed segments that are not otherwise shown herein.

The gripper disc 7 is arranged between two rollers 16 mounted at an angle and rotatably positioned on a pipe 9 that is mounted rigidly on the frame 3. Two rods 12, which are respectively connected rigidly to the drive pulley 17 and perpendicular to the frame, are used as a drive for the two slanted rollers 16. Two balls 13 are arranged on each rod 12 to respectively connect a rod 12 to a slanted roller 16. The balls 13 are arranged such that they can move inside a radial guide slot 14. Both slanted rollers 16 are rotatably positioned with a bearing 18 on the respective pipe 9. The rollers 16 are slanted relative to the shaft 6 at an angle ranging from 20 to 40°, preferably approximately 30°. Both rollers 16 are aligned parallel to each other and rotate in the direction of arrow 31.

Identically aligned continuous belts 19 are fitted around two deflection rollers 21 and 49 and are provided with nose-shaped, forward extending regions 19*a*. The belts 19 are respectively fitted around each slanted roller 16. Each of the belts 19 operates jointly with a respective lower belt 20 fitted around two rollers 22 and 23 arranged at a distance to each other, and extends with the same alignment and angle of the rollers 16. The lower belts 20 are respectively tensioned against one of the slanted rollers 16 and are driven by the roller or the belt 19 that is fitted against it. The lower belts 20 can also be driven separately via the roller 23. Following a respective rotation of the gripper disc 7 of approximately 150°, withdrawn printed products 5 are picked up by the belts 19 and 20 and are conveyed in the direction of arrow 47, as shown in FIG. 2. When gripping a printed product 5 with belts 19 and 20, the printed product 5 is pulled completely off the stack 4 and is guided through a guide element (not shown) extending parallel to the circumference of the gripper drum. The grippers 8 are opened simultaneously, and belts 19 and 20 convey the printed product 5.

The dashed line 48 in FIG. 2 indicates the direction in which the printed products 5 are conveyed by the belts 19 and 20. The products are conveyed linearly at an angle $\alpha$ slanted to the conveying direction, that is the longitudinal direction of a conveying channel 25, also referred to as an insertion channel. The angle $\alpha$ measures 20 to 40°, preferably approximately 30°. The conveying channel 25, of which only sections are shown in FIGS. 1 and 2, is open on the top and is provided with a bottom 53 and at least one guide wall 26 on the side of the channel. An endless conveying element 28, in particular a chain, circulates below the bottom 53 and is provided at regular intervals and with specific divisions with carriers 29. These carriers 29 project through a longitudinal slot 27 into the conveying channel 25. The carriers 29 serve to convey the printed products 5 inside the conveying channel 25. In FIGS. 1 and 2, the printed products are conveyed in the direction of arrow 52, from right to left. Accordingly, the carriers 29 inside the conveying channel 25 move in the direction of arrow 52. Thus, the longitudinal direction of conveying channel 25 corresponds to the conveying direction. As shown in particular in FIG. 2, the slanted rollers 16 are slanted with respect to the conveying direction 52. The printed products 5 are conveyed in the conveying channel 52, as shown in FIG. 2, with a speed v1 which is composed of the speed components v2 and v3. Because of the slanted transport, the printed products 5 are pre-accelerated in the conveying direction of the conveying channel 25. The speed v2 in the conveying direction increases while the angle $\alpha$ increases and the speed transverse to the conveying direction decreases. Thus, the magnitude of the pre-acceleration can be adjusted by changing angle $\alpha$.

Figure 3:
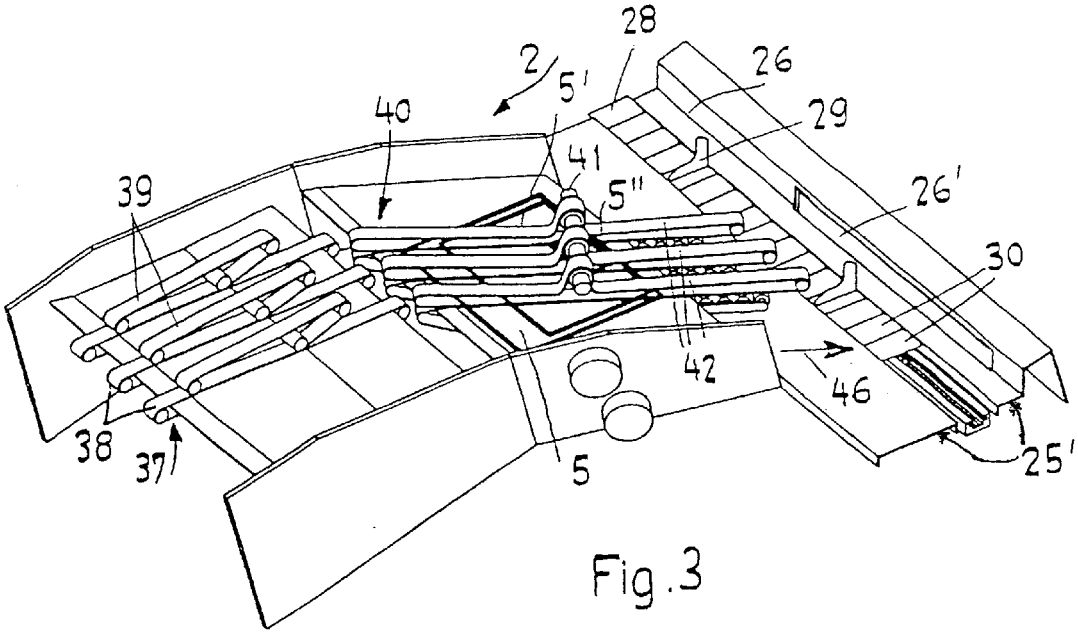
FIG. 3 shows a schematic three-dimensional view of a different embodiment of the device according to the present invention.
Figure 4:
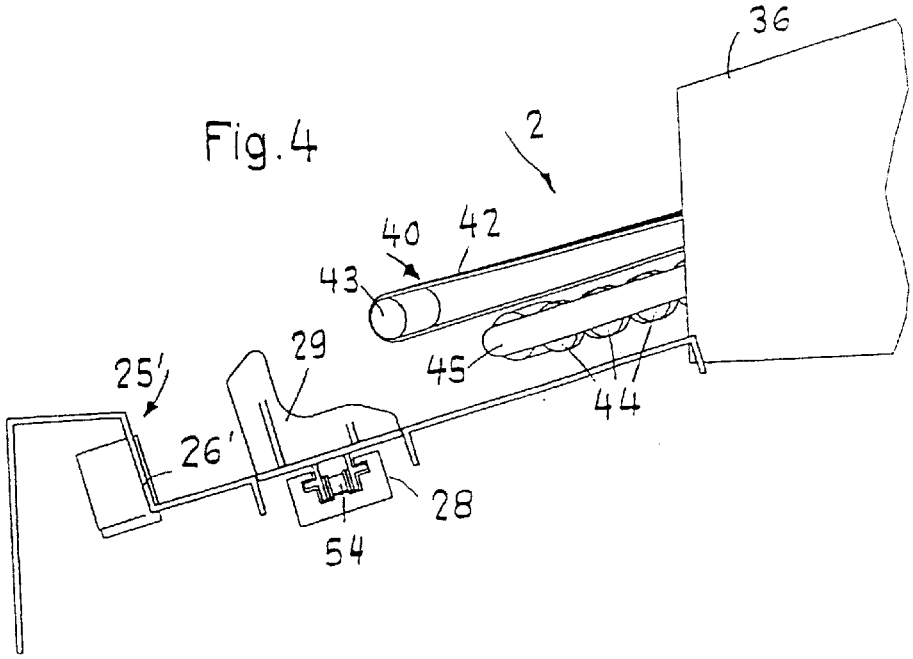
FIG. 4 shows top view of the device according to FIG. 3.

The device 2, shown in FIGS. 3 and 4, is provided with a conveying channel 25' in which the above-mentioned conveying element 28 is arranged. The carriers 29 are comparably wide, platform-shaped, articulated links 30 of an endless platform chain 54.

The printed products 5 are inserted into the conveying channel 25' with the two belt groups 37 and 40 positioned on a frame 36 and, preferably, provided with separate drives. The belt group 37 conveys the printed products 5 transverse to the conveying direction of conveying channel 25' and is provided with lower belts 38, which respectively cooperate with upper belts 39. The printed products 5 are taken by the belt group 37 from a feeder (not shown) or another machine, for example, a trimmer. The printed products 5 can be supplements, for example, individual printed sheets, or can be main products such as newspapers, magazines, or the like. The printed products 5 are transferred by belt group 37 to belt group 40 to convey the printed products 5 in the direction 46 and at an angle to the conveying direction of conveying channel 25'. The format for the printed products 5 can differ. Thus, printed products 5' with an average format or even printed products 5" with a comparably small format can be inserted into the conveying channel 25' without adjustment to the device. The upper belts 39 of belt group 37 can be adjusted in a running direction to ensure that the printed products 5 are deflected by an angle $\alpha$ over the complete format range. With each format type, the back end of the printed product 5 is therefore released by the belt group 37 before it is gripped at the binding by the belt group 40. In the frontal region of the device 2, the printed products 5 are conveyed by upper belts 42 and oppositely arranged rollers 44 positioned on a telescoping driver 45. The upper belts 42 are driven by a joint drive shaft 41 and, at each front end, are fitted around a respective roller 43. These rollers 43 are arranged, as shown in FIG. 4, such that each upper belt 42 projects over the carrier 45. The printed products 5 can be conveyed in the region of belt group 40 such that they are delayed by a separately driven drive shaft 41. The drive shaft can be controlled, for example, with a electric motor (not shown). A delay can reduce the force of impact between printed products 5 and the guide wall 26 of the conveying channel. Thus, the printed products 5 can be inserted with increased speed between the carrier 29 and can be delayed just prior to impacting with the guide wall 26, meaning the printed products can be inserted either with increased or decreased speed gently into the conveying channel 25'. For an even more careful treatment of printed products 5', the guide wall 26 can be designed to be a belt 26' that circulates with the same speed as carriers 29. Belt 26' reduces or eliminates a braking effect on the printed product by the guide wall 26.

Figure 5:
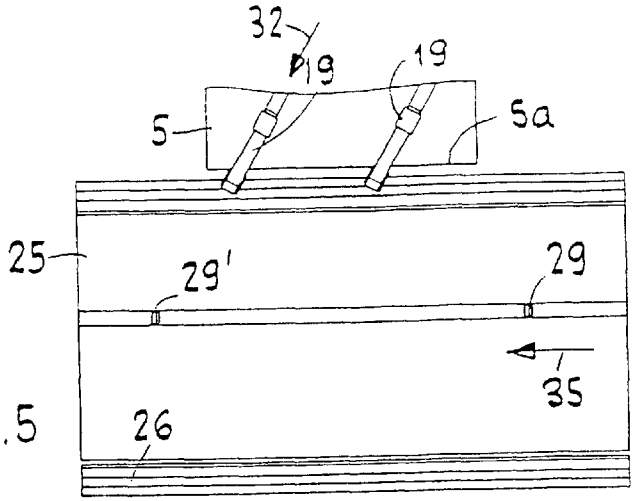
FIGS. 5 to 7 each show schematic views of individual phases during which a printed product is inserted at an angle into a conveying channel.
Figure 6:
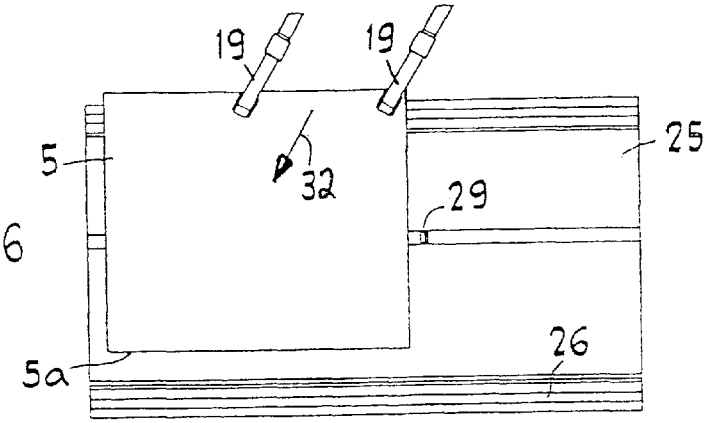
Figure 7:
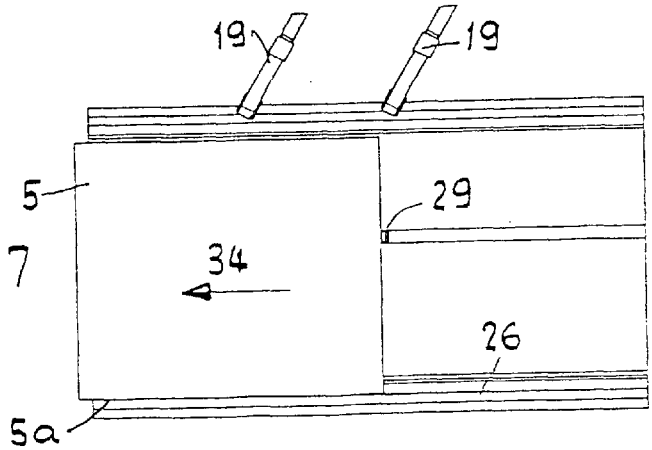

The device 1, shown in FIGS. 5 to 7, is used to explain in further detail the method of inserting printed products 5 into the conveying channel 25, as well as conveying the printed products inside the conveying channel 25. In principle, the device 2, shown in FIGS. 3 and 4, uses the same operational steps.

FIG. 5 shows that the printed products 5 are conveyed with the aid of belts 19 and 20 (not visible in FIGS. 5–7), at an angle to the conveying direction of conveying channel 25, with the front binding 5*a* always aligned parallel to the conveying direction, indicated by arrow 35. With the device 2, the printed products 5 are conveyed in the same way, but with the aid of belts 42 in the direction of arrow 32. The conveying speed of printed products 5 is synchronized with the speed of conveying element 28 and is adjusted such that a printed product 5 is inserted respectively between a carrier 29' and a following carrier 29.

FIG. 6 shows a printed product 5 that is mostly positioned inside the conveying channel 25, wherein the binding 5*a* has not yet reached the guide wall 26. As a result of the slanted insertion, the printed product 5 moves with speed v2 in the conveying direction of the conveying channel 25. The printed product 5 is thus pre-accelerated in the conveying direction, as shown with arrow 35. An increase in the insertion speed permits an even smaller division, i.e., a smaller spacing between consecutive carriers 29 and 29'.

FIG. 7 shows the position in which the printed product 5 fits with the binding 5*a* against the guide wall 26 and simultaneously receives a push from the carrier 29, so that it is further accelerated in conveying direction 34 of the conveying channel 25. As a result of the above-mentioned pre-acceleration, the acceleration push from the carrier 29 is not as great as would otherwise be required. Owing to the slanted insertion, the impact of binding 5*a* with the guide wall is additionally reduced. If, as explained in the above, the printed product 5 is delayed just prior to impacting with the guide wall 26, then this impact is further reduced. The printed products 5 are guided particularly securely inside the conveying channel 25 if the carriers 29 are designed comparably wide, as shown in FIGS. 3 and 4. The acceleration push is distributed over a wider width of the printed product, thereby leading to a more gentle treatment of the printed products 5. As explained above, the printed product 5 can be a main product or a supplement that is inserted into the main product. Main products into which a supplement must be inserted are conveyed opened in a known manner. The angled position of the carrier 29, shown in FIGS. 3 and 4, in particular permits an opening of the printed product. If the conveying channel 25', shown in FIGS. 3 and 4, is slanted toward the guide wall 26, the printed products 5 that are inserted into the conveying channel 25' automatically align themselves with particular reliability. FIG. 7 in particular shows that the belts 19 will guide the inserted printed product 5 until just before impact with the guide wall 26. The belts 42 perform the same function with the device 2, shown in FIGS. 3 and 4.

The invention has been described in detail with respect to preferred embodiments, and it will now be apparent from the foregoing to those skilled in the art, that changes and modifications may be made without departing from the invention in its broader aspects, and the invention, therefore, as defined in the appended claims, is intended to cover all such changes and modifications that fall within the true spirit of the invention.

What is claimed is:

1. A device for feeding printed products to a conveying channel in which the printed products are conveyed with carriers of a conveying element, wherein the device includes means for positively accelerating the printed product, the accelerating means conveying the printed products in essentially a straight line and at an acute angle relative to the conveying direction of the conveying channel.

2. The device according to claim 1, wherein the accelerating means includes at least one conveyor belt to supply the printed products at an angle to the conveying channel.

3. The device according to claim 1, wherein the accelerating means includes two conveying belts to supply the printed products to the conveying channel.

4. The device according to claim 1, wherein the accelerating means is oriented such that the printed products are fed to the conveying channel at a feed angle of between 20° to 40° relative to the conveying direction.

5. The device according to claim 4, wherein the feed angle is 30° relative to the conveying direction.

6. The device of claim 1, wherein said accelerating means accelerates the printed sheets in a conveying direction after the sheets are removed from a magazine.

7. The device of claim 1, wherein sheets are removed from a magazine in an a direction perpendicular to the conveying direction, and subsequent to the removal, said acceleration means accelerate the sheet in the conveying direction.

8. A device for feeding printed products to a conveying channel, comprising:

a feeding apparatus; and means for positively accelerating the printed products received from the feeding apparatus, the accelerating means conveying the printed products in essentially a straight line and at an acute angle relative to the conveying direction of the conveying channel.

9. The device of claim 8, wherein the feeding apparatus is a drum feeder.

10. The device of claim 8, wherein the accelerating means is integrated with the feeding apparatus.

11. The device according to claim 8, wherein the accelerating means includes at least one roller slanted relative to the conveying direction of the conveying channel.

12. The device according to claim 11, wherein the feeder apparatus includes two frame sections and at least one rigid pipe mounted between the two frame sections, wherein the at least one roller comprises two rollers being positioned at a distance relative to each other on the at least one pipe.

13. The device according to claim 12, wherein the feeder apparatus includes a shaft arranged on the frame sections and a gripper disc arranged on the shaft for pulling the printed products from a stack, and wherein the pipe is arranged coaxial to the shaft.

14. The device according to claim 11, wherein one of the accelerating means and feeding apparatus includes at least two belts for guiding the printed products around the at least one roller.

15. The device according to claim 13, wherein the at least one pipe is supported on the shaft.

16. The device according to claim 13, wherein the gripper disc is arranged between the two rollers.

17. The device according to claim 11, wherein the feeder apparatus further includes at least one guide rod for driving the at least one roller.

18. The device according to claim 16, wherein the rollers are arranged at an angle of between 20° to 40° relative to the shaft.

19. The device according to claim 13, wherein the shaft of the feeder apparatus extends parallel to the conveying direction of the conveying channel.

20. The device according to claim 8, wherein the accelerating means comprises two conveying components.

21. A The device according to claim 20, wherein the two conveying components have separate drives.

22. The device according to claim 21, wherein the two conveying components are driven such that the printed products are fed with increased speed into the conveying channel and are delayed prior to insertion into the conveying channel.

23. A conveying device for conveying printed products, comprising:

a feeding apparatus for removing the printed products from a stack;

a conveying channel downstream of the feeding apparatus for conveying the printed products in a conveying direction; and means for positively accelerating the printed products received from the feeding apparatus, the accelerating means conveying the printed products in essentially a straight line and supplying the printed products at an acute angle relative to the conveying direction of the conveying channel.

24. The device according to claim 23, wherein the conveying channel has a guide wall formed at least in part by a belt that circulates around perpendicular shafts.

25. The device according to claim 23, wherein the conveying channel includes a conveying element and carriers arranged on the conveying element for conveying the printed products.

26. The device according to claim 25, wherein the carriers are angled relative to the conveying channel and are approximately as wide as the printed products.

27. The device according to claim 25, wherein the conveying element is a conveyer chain.

28. The device according to claim 23, wherein the conveying channel includes at least one guide wall and a bottom which is one of horizontal and slanted relative to the conveying direction.

* * * * *